US006627069B2

(12) United States Patent
Greaney

(10) Patent No.: US 6,627,069 B2
(45) Date of Patent: Sep. 30, 2003

(54) METHOD FOR REDUCING THE NAPHTHENIC ACID CONTENT OF CRUDE OIL AND ITS FRACTIONS

(75) Inventor: Mark Alan Greaney, Upper Black Eddy, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 59 days.

(21) Appl. No.: 09/957,882

(22) Filed: Sep. 21, 2001

(65) Prior Publication Data

US 2002/0011430 A1 Jan. 31, 2002

Related U.S. Application Data

(63) Continuation-in-part of application No. 09/551,659, filed on Apr. 18, 2000.

(51) Int. Cl.[7] ..... C10G 19/02; C10G 21/00

(52) U.S. Cl. ..... 208/263; 208/283; 208/284; 208/289

(58) Field of Search ..... 208/263, 283, 208/284, 289

(56) References Cited

U.S. PATENT DOCUMENTS

| | | | | |
|---|---|---|---|---|
| 4,199,440 | A | 4/1980 | Verachtert | 208/230 |
| 4,634,519 | A | 1/1987 | Danzik | 208/263 |
| 4,647,366 | A | 3/1987 | Edmondson | 208/47 |
| 5,683,626 | A | 11/1997 | Sartori et al. | 252/389.62 |
| 6,007,705 | A | 12/1999 | Greaney et al. | 208/251 R |

FOREIGN PATENT DOCUMENTS

| | | | |
|---|---|---|---|
| WO | WO9708270 | 3/1997 | C10G/19/00 |

OTHER PUBLICATIONS

Othmer, Napthenic Acids, Mannan Talukder, Curtis R. Kates, Advanced Aromatics, Inc., vol. 16, pp. 1017–1029.

Starks, Liotta, Halpern, Phase–Transfer Catalysis, Fundamentals, Applications, and Industrial Perspectives, pp. 274–285.

*Primary Examiner*—Walter D. Griffin
*Assistant Examiner*—Tam M. Nguyen
(74) *Attorney, Agent, or Firm*—Linda M. Scuorzo

(57) ABSTRACT

The present invention relates to a process for reducing naphthenic acid content of crude oils and its fractions in the essential absence of oxygen and in the presence of an aqueous base selected from Group IA and IIA hydroxides and ammonium hydroxide and mixtures thereof, a phase transfer agent that is a quaternary onium salt in amounts of from $10^{-5}$ to $10^{-1}$ at a temperature and pressure effective to produce a treated petroleum feed having a decreased naphthenic acid content and an aqueous phase containing naphthenate salts, phase transfer agent and base.

10 Claims, No Drawings

METHOD FOR REDUCING THE NAPHTHENIC ACID CONTENT OF CRUDE OIL AND ITS FRACTIONS

This application is a continuation-in-part under 37 CFR 1.53(b) of U.S. application Ser. No. 09/551,659 filed Apr. 18, 2000.

FIELD OF THE INVENTION

The present invention relates to a method for reducing the naphthenic acid content of crude oil and its fractions

BACKGROUND OF THE INVENTION

Whole crudes with high organic acid content such as those containing naphthenic acids are corrosive to the equipment used to extract, transport and process the crude.

Efforts to minimize naphthenic acid corrosion have included a number of approaches. U.S. Pat. No. 5,182,013 refers to such recognized approaches as blending of higher naphthenic acid content oil with low naphthenic acid content oil. Additionally, a variety of attempts have been made to address the problem by using corrosion inhibitors for the metal surfaces of equipment exposed to the acids, or by neutralizing and removing the acids from the oil. Examples of these technologies include treatment of metal surfaces with corrosion inhibitors such as polysulfides (U.S. Pat. No. 5,182,013) or oil soluble reaction products of an alkynediol and a polyalkene polyamine (U.S. Pat. No. 4,647,366), or by treatment of a liquid hydrocarbon with a dilute aqueous alkaline solution, specifically dilute aqueous NaOH or KOH (U.S. Pat. No. 4,199,440). U.S. Pat No. 4,199,440 notes, however, that a problem arises with the use of aqueous solutions that contain higher concentrations of base. These solutions form emulsions with the oil, necessitating use of only dilute aqueous base solutions. U.S. Pat. No. 4,300,995 discloses the treatment of carbonous material particularly coal and its products, heavy oils, vacuum gas oil petroleum resids having acidic functionalities with a dilute quaternary base such as tetramethylammonium hydroxide in a liquid (alcohol or water).

U.S. Pat. No. 4,634,519 teaches a process for extracting naphthenic acids from petroleum distillates using a solvent system comprising liquid alkanols, water and ammonia in certain critical ratios to facilitate selective extraction and easy separation. The patent reaches away from use of the process to treat whole crudes, due to the formulation of an emulsion that prevented separation of the naphthenic acids (see Example 1A). What is needed is a process for separating not only certain crude fractions, but also whole crudes. Applicants' invention address these needs.

SUMMARY OF THE INVENTION

The present invention provides for a method for decreasing the naphthenic acid content of refinery streams by contacting a crude oil or a petroleum distillate stream in the presence of an effective amount of water, a base selected from Group IA and IIA hydroxides and ammonium hydroxide and a phase transfer agent at an effective temperature (i.e., at which the water is liquid to 180° C.) for a time sufficient to produce a treated petroleum feed having a decreased naphthenic acid content and an aqueous phase containing naphthenate salts, phase transfer agent and base.

Advantageously, this process facilitates the extraction of higher molecular weight naphthenic acids (in addition to lower molecular weight naphthenic acids), which otherwise would remain in the petroleum stream following extraction with caustic alone. This results in lower TAN content and reduced refinery equipment corrosion. Additionally, the presence of the phase transfer agent has been found to reduce the emulsion formation upon caustic treatment, and this leads to enhanced processibility.

The present invention may suitably comprise, consist or consist essentially of the described elements and may be practiced in the absence of an element not disclosed, for example in the absence of oxygen.

DETAILED DESCRIPTION OF THE INVENTION

The present invention provides for a method for decreasing the naphthenic acid content of hydrocarbonaceous feedstreams by contacting the stream (also referred to herein as a fraction, feedstream or feed) containing the naphthenic acids to be removed with an effective amount of aqueous base selected from Group IA and IIA hydroxides and ammonium hydroxide, and at least one phase transfer agent at an effective temperature at which the aqueous phase remains liquid, typically up to 180° C. to produce a treated petroleum stream having a decreased naphthenic acid content and an aqueous phase containing naphthenate salts, phase transfer agent and base. The contacting is carried out at a pressure that corresponds to the reaction temperature and is typically from zero to less than 10,000 kPa. Lower pressures are preferred because this can minimize the need for high-pressure treatment process units. Optionally, the aqueous phase may be recovered and the naphthenic acid salts separated from the phase transfer agent and base, to recycle and reuse the phase transfer agent and base for treatment of additional hydrocarbonaceous feedstream.

The naphthenic acid species that are most desirably removed by the process of the present invention are monobasic carboxylic acids of the general formula RCOOH, where R represents the naphthenic moiety consisting of cyclopentane and cyclohexane derivatives. Naphthenic acids are composed predominantly of alkyl-substituted cycloaliphatic carboxylic acids, with smaller amounts of non-cycloaliphatic acids. Aromatic, olefinic, hydroxy and dibasic acids may also be present as minor components. The molecular weight (as determined by mass spectrometry) of the naphthenic acids found in crudes vary over a wide range, typically from 200–700, though naphthenic acids falling within the lower portion of the 200–700 are readily extracted from petroleum streams by treatment with dilute caustic (see Kirk Othmer, Encyclopedia of Chemical Technology, 4th edition Volume 16 pages 1017–1029 (1995)). The higher molecular weight naphthenic acids are not so readily removed due to the formation of emulsions. Addition of co-solvents such as ethanol are required to facilitate their removal.

Advantageously, this process facilitates the extraction of higher molecular weight naphthenic acids (in addition to lower molecular weight naphthenic acids), which otherwise would remain in the petroleum stream following extraction with caustic alone. This results in lower TAN content and reduced refinery equipment corrosion. Additionally, the presence of the phase transfer agent has been found to reduce the emulsion formation upon caustic treatment, and this leads to enhanced processibility.

Bases preferred are strong bases, e.g., NaOH, KOH, ammonium hydroxide, sodium and potassium carbonates. These may be used as an aqueous solution of sufficient strength, typically at least 5 wt % of the aqueous phase.

The phase transfer agent is present in a sufficient concentration to result in a treated feed having decreased naphthenic acid content. The phase transfer agent may be miscible or immiscible with the stream to be treated. Typically, this is influenced by the length of the hydrocarbyl chain in the molecule; and these may be selected by one skilled in the art. While this may vary with the agent selected typically concentrations of 0.05 to 10 wt %, preferably 0.1 to 5 wt % are used. As known to those skilled in the art phase transfer, agents can be used effectively in amounts as low as $10^{-5}$ to $10^{-1}$ of the aqueous phase. Quaternary onium salts can be used in these amounts.

Examples of suitable phase transfer agents include quaternary onium salts, that is, basic quaternary onium salts (i.e. hydroxides), non-basic quaternary onium salts such as quaternary onium halides, (e.g. chlorides), hydrogen sulfates, crown ethers, open-chain polyethers such as polyethylene glycols, and others known to those skilled in the art either supported or unsupported. The basic quaternary onium salts and non-basic quaternary onium salts must be "accessible" and sufficiently organophilic to form an ion pair (with a hydroxide anion) that is sufficiently soluble in the petroleum stream to facilitate phase transfer. Phosphonium and ammonium cations are suitable, with ammonium typically being more desirable for reasons of cost and stability. Most preferable are quaternary ammonium cations which contain a first alkyl, preferably substantially linear, group having a carbon chain length of from one to three, preferably one to two, more preferably one carbon atom attached to the central atom of the onium cation; and a second alkyl, preferably linear, group having at least four carbons, preferably four to twenty carbons, attached to the central atom of the onium cation, and two remaining hydrocarbyl groups each having an indivdual chain length of from 1 to 20 carbon atoms attached to the central atom of the onium cation. Examples include cetyl trialkyl, e.g., cetyl trimethyl, ammonium, and alkyl trioctyl, e.g. methyl trioctyl ammonium. The lengths of the hydrocarbyl chains may be varied within the disclosed ranges and the hydrocarbyl groups may be branched or otherwise substituted with non-interfering groups, provided that the accessibility and suitable organophilic nature is maintained. In the phase transfer catalysis literature, this class of onium salt is referred to as "accessible", in that the structure allows for close approach and strong electrostatic interaction of the onium cation and the hydroxide anion, $OH^-$. (see Phase Transfer Catalysis: Fundamentals, Applications and Industrial Perspectives by C. Starks, C. Liotta and M. Halpern (Chapman and Hall, N.Y. 1994) pp 274–285). While not wishing to be bound by any mechanistic limitations, we postulate that the success of the present invention may be attributable, in part, to the ability of the phase transfer catalyst to transport hydroxide anions from the aqueous phase into the petroleum stream wherein the hydroxide anion reacts in an acid base reaction with the naphthenic acid to produce a napthenate anion.

$$RCOOH\ (\text{petroleum}) + OH^{-1} \rightarrow RCOO^{-1}(\text{aqueous}) + H_2O$$

This resulting anionic species is less soluble in the petroleum stream due to its electrostatic charge and preferentially equilibrates to the aqueous stream.

Process temperatures at which the aqueous phase remains liquid are used typically up to 180° C. are suitable; however, temperatures of less than 150° C., less than 120° C. can be used depending on the nature of the feed and phase transfer agent used.

Crude oils desirably may be treated by the process of the invention, and especially desirable to treat are crude oils which are referred to as "high TAN" crudes (with TAN>1, by ASTM D664 or D974) such as derived from California, Venezuela, Russia, as well as other regions of the world. Examples of other streams that may be treated according to the process of the present invention are naphthenic acid containing carbonaceous and hydrocarbonaceous processed/distilled streams such as kerosene, diesel, atmospheric gas oil (AGO), vacuum gas oils (VGO).

The feed to be treated can have a range of naphthenic acid content. The average Total Acid Number (TAN) will vary by the feed, but is typically about 0.5 mg KOH/g to 10 mg KOH/g, preferably about 2 to 10 mg KOH/g. As noted above, TAN can be used to measure the naphthenic acid content of a petroleum stream, but equally valid measurement of the decrease in naphthenic acid content of a treated stream may be obtained by monitoring the carboxyl band in the infrared spectrum at 1708 $cm^{-1}$.

The feed to be treated preferably should be in a liquid or fluid state at process conditions. This may be accomplished by heating the material or by use of a suitable non-interfering solvent as needed. These may be selected by those skilled in the art.

Preferably the oil droplets should be of sufficient mean droplet size to enable the naphthenic acid containing components to achieve intimate contact with the aqueous phase. Oil droplet particles having a mean droplet size of about 1 to 100 microns (diameter) should be typical, and 1 to 20 are preferably; larger droplet sizes of greater than 100 microns are not preferable. Contact can be achieved, e.g., by vigorous mixing for the components of the mixture.

Desirably the process should be carried out for a time and at conditions within the ranges disclosed sufficient to achieve a decrease, preferably a maximum decrease, in naphthenic acid content of the naphthenic acid containing petroleum stream.

Reaction temperatures will vary with the particular stream to be treated due to its viscosity. An increase in temperature may be used to facilitate removal of species. Within the process conditions disclosed a liquid or fluid phase or medium should be maintained.

Treatment typically removes the naphthenic acid containing species from the petroleum phase into an aqueous base phase or a third phase containing the phase transfer agent. Following treatment, the treated stream has a decreased content of naphthenic acids.

Optionally, a naphthenic acid recovery or extraction step may be added, as needed to recover the naphthenic acid species removed from the treated distillate stream from the aqueous phase. The nature of any such step(s) depends on the nature of the bed/reactor, solubility or insolubility of the removed naphthenic acid species in the aqueous phase. For separation/extraction purposes at least two phases are present, into at least one of which the naphthenic acid species are removed or extracted. The phase into which extraction occurs can be the second phase, i.e., the phase containing transfer agent and aqueous base or a third phase containing primarily aqueous base, with the second (intermediate) phase containing primarily phase transfer agent. The first phase is the treated petroleumstream.

The naphthenic acid content decreased (i.e., upgraded) product may be used in refining operations, with a reduction in equipment corrosion.

A benefit to the present invention is that the process may be operated with a minimization of undesirable emulsion formation and removal of the most difficult to extract higher molecular weight naphthenic acids.

What is claimed is:

1. A process for decreasing the naphthenic acid content of petroleum stream, comprising:

contacting a naphthenic acid containing petroleum stream in the presence of an effective amount of an aqueous phase containing water, inorganic base selected from Group IA and IIA hydroxides and ammonium hydroxide and mixtures thereof, and a phase transfer agent from accessible basic and non-basic quatemary onium salts, in an effective amount of from $10^{-5}$ to $10^{-1}$ of the aqueous phase at an effective temperature for a time sufficient to produce at least a treated petroleum stream having a decreased naphthenic acid content, and an aqueous phase containing naphthenate salts, phase transfer agent and base.

2. The process of claim 1 wherein the base is selected from NaOH,KOH, ammonium hydroxide, and mixtures thereof.

3. The process of claim 1 wherein the temperature is up to 180° C.

4. The process of claim 1 wherein the non-basic quaternary onium salt is selected from quatemary onium halides and quaternary onium hydrogen sulfates.

5. The process of claim 1 wherein the phase transfer agent is selected from cetyl trimethyl onium salts.

6. The process of claim 1 wherein the basic quatemary onium salt is a quaternary onium hydroxide.

7. The process of claim 1 wherein the cation of the quaternary onium salt has one alkyl group with a chain length of from 4 to 20 carbons and the three remaining alkyl groups selected from alkyl groups with a chain length of from 1 to 2 carbons, and mixtures thereof.

8. The process of claim 1 wherein the cation of the quaternary onium salt has at least one alkyl group with a 14 to 20 carbon length chain.

9. The process of claims 1 and 5 wherein the onium salt is selected from ammonium and phosphonium salts.

10. The process of claim 1 wherein the inorganic base is present in an amount of at least 5 wt % of the aqueous phase.

* * * * *